US006336666B1

(12) United States Patent
Trantoul

(10) Patent No.: US 6,336,666 B1
(45) Date of Patent: Jan. 8, 2002

(54) METHOD FOR MAKING A FILM WITH PATTERN PREVENTING REPRODUCTION BY OPTICAL SCANNING FOR THE PROTECTION OF DOCUMENTS

(76) Inventor: François Trantoul, Mas "le Cantadou", 1312 chemin du, Pont des Anes - 34400 Lunel (FR)

( * ) Notice: Subject to any disclaimer, the term of this patent is extended or adjusted under 35 U.S.C. 154(b) by 0 days.

(21) Appl. No.: 09/403,421

(22) PCT Filed: Apr. 20, 1998

(86) PCT No.: PCT/FR98/00792

§ 371 Date: Oct. 21, 1999

§ 102(e) Date: Oct. 21, 1999

(87) PCT Pub. No.: WO98/47714

PCT Pub. Date: Oct. 29, 1998

(30) Foreign Application Priority Data

Apr. 21, 1997 (FR) ..... 97 05101

(51) Int. Cl.[7] ..... B42D 15/00

(52) U.S. Cl. ..... 283/108; 283/107; 283/902; 283/67; 283/91; 283/86

(58) Field of Search ..... 283/67, 70, 86, 283/72, 94, 117, 101, 91, 901, 902; 428/913, 916; 156/277

(56) References Cited

U.S. PATENT DOCUMENTS

| | | | | | |
|---|---|---|---|---|---|
| 5,106,125 | A | * | 4/1992 | Antes | 285/86 |
| 5,232,527 | A | | 8/1993 | Vernhet et al. | |
| 5,714,213 | A | * | 2/1998 | Antes et al. | 283/72 X |
| 5,743,981 | A | * | 4/1998 | Lu | 156/182 |
| 5,886,798 | A | * | 3/1999 | Staub et al. | 283/86 X |
| 6,000,727 | A | * | 12/1999 | DeRose et al. | 283/86 |

FOREIGN PATENT DOCUMENTS

| | | |
|---|---|---|
| EP | 0 234 121 | 9/1987 |
| EP | 0 271 941 | 6/1988 |
| EP | 0 429 782 | 6/1991 |
| FR | 2 429 292 | 1/1980 |
| FR | 2 675 742 | 10/1992 |

* cited by examiner

*Primary Examiner*—Willmon Fridie, Jr.
(74) *Attorney, Agent, or Firm*—Young & Thompson

(57) ABSTRACT

In producing a film by printing on a top sheet with non-glossy surface, a first glossy varnish imprint adheres on the surface. A second continuous imprint produced on the first, adheres neither on the top sheet nor on the varnish, and the film is completed. A glossy imprint is thus provided in the film external surface which is then applied on a document to protect it from being reproduced by optical scanning.

23 Claims, 2 Drawing Sheets

METHOD FOR MAKING A FILM WITH PATTERN PREVENTING REPRODUCTION BY OPTICAL SCANNING FOR THE PROTECTION OF DOCUMENTS

BACKGROUND OF THE INVENTION

The invention relates to a method for production of a film which has a surface made of synthetic material, known as the outer surface, which is designed to be on view, and a symbol or pattern, which prevents reproduction by optical scanning, and is visible from this outer surface side. The invention also extends to a film of this type, a protective transfer comprising a film of this type, a method for protection of a document or other element by means of a film of this type or a transfer of this type, and a document thus protected by means of a film of this type.

DESCRIPTION OF THE RELATED ART

In order to prevent reproduction by optical scanning (photocopy, photograph, scanner, etc) of official documents such as bank notes, credit cards, cheques, identity documents, etc, it is already known (FR-2 429 292) to use a paper or a printing support comprising iridescent patterns which produce visual effects which vary according to the direction of observation. This iridescence is obtained by adding an iridescent composition to the surface of the paper or printing support.

However, in this method, simply scratching the surface makes it possible to remove the iridescent composition of an original. In addition, the same iridescent patterns can be produced on the support used for reproduction of the document, before or after this reproduction.

In addition, use of these iridescent compositions is costly, and complicates considerably the production of the paper or printing support, and of the document obtained.

EP-A-0,429,782 describes micro-structures such as holograms on printed bank notes. In order to use these micro-structures, an embossed security profile is used, which has a specific number of embossed lines recessed and/or in relief, and flat intermediate spaces. The security profile is inserted by embossing, after application onto the note of a sheet comprising the security micro-structure. It should thus be noted that all the facets defined by the embossing lines have the same condition of glossiness.

SUMMARY OF THE INVENTION

The object of these micro-structures is to combat forgery, and not to prevent reproduction by optical scanning. In addition, production of these micro-structures is problematic and costly.

The object of the invention is thus to eliminate these disadvantages, by providing a more efficient method for protection of documents against reproduction by optical scanning. The object of the invention is also to provide a method of this type, which is simple, cheap, and does not complicate the production either of the printing support, or that of the document itself.

For this purpose, the invention relates to a method for protection of a surface of a document, against reproduction by optical scanning, wherein there is applied irreversibly to this surface at least one film which has an imprint recessed in one surface, known as the outer surface, which is on view, of a layer of synthetic material of the film, this imprint having a surface condition which is more glossy than the remainder of the said outer surface, this imprint forming a symbol or pattern which is on view, and prevents reproduction of the document by optical scanning.

The expression "the film is applied irreversibly" means that the film can then no longer be separated from the document without damaging or destroying the film and/or the document.

Throughout the text, "an imprint" means one or a plurality of combined or separate marks of any shape which are recessed. This imprint forms a symbol (which in particular can be character, and/or a group of characters, and/or a letter, and/or a group of letters, and/or a word, and/or a group of words, and/or a drawing, and/or a group of drawings, and/or a combination of these symbols), or a pattern, ie. a plurality of symbols which can be repeated regularly or non-regularly.

Throughout the text, a surface is said to be glossy when it has glossiness in white light at 85° (angle of incidence of the light), for example measured on the BYK GARDNER brightness measurer, greater than 50%; a surface is said to be non-glossy when it has glossiness in white light at 85° of less than 50%, a surface is said to be matt when it has glossiness in white light at 85° of less than 30%. In the case of layers produced by printing, and in particular by silk-screen printing, it is known that the glossiness is associated with the surface condition. Thus, a surface is more glossy when its surface condition is less rough. The glossiness or dullness of a surface can thus also be evaluated by measuring the roughness.

Advantageously and according to the invention, the film is applied to the surface of the document by means of an adhesive. Advantageously and according to the invention, a film formed from a plurality of layers is used, the layer which has the said outer surface being a matt polyurethane layer which is provided with an imprint which is recessed and has a glossy surface condition.

The object of the invention is also to provide means for implementing this method for protection, ie. a film which is designed to be used in this method for protection, a protective transfer, and a method for production of a film of this type, and of a protective transfer of this type.

Throughout the text, "transfer" means a product which comprises at least one film and one support sheet, and which is designed to permit application of the film onto a surface of a document to be protected, the film being transferred from the support sheet onto the surface of the document by contact and activation of an adhesive which bonds the film and the surface of the document, and separation of the support sheet.

The invention thus also relates to a method for production of a film which has a surface made of synthetic material, known as the outer surface, which is designed to be on view, and a symbol or pattern which prevents reproduction by optical scanning, and can be seen from this outer surface side, wherein

- a support sheet with a non-glossy surface is selected, onto which the synthetic material of the said outer surface of the film does not adhere;
- on the said non-glossy surface, a first, discontinuous imprint is produced by means of a printing composition, which, after hardening and/or drying, forms a varnish which adheres to the said non-glossy surface, this varnish having a surface condition which is more glossy than that of the said non-glossy surface, and which in particular is a glossy surface condition;
- subsequently, on this first imprint, there is produced a second continuous imprint of a printing composition, which, after hardening and/or drying, forms a layer of synthetic material, one surface of which, which is in contact with the said non-glossy surface and with the varnish, constitutes the said outer surface of the film, which does not adhere to the said non-glossy surface, this layer of synthetic material being compatible with the varnish of the first imprint, and not adhering to this varnish, or adhering to this varnish less strongly than this varnish adheres itself to the said non-glossy surface of the support sheet, such that, after subsequent separation of the film and the support sheet, this varnish continues to be associated with the support sheet, the said outer surface of the film having a more glossy imprint, and in particular a glossy imprint, which is left by the varnish recessed in the said outer surface, and forms a symbol or pattern which is on view, and prevents reproduction by optical scanning; and production of the film is completed above the said layer of synthetic material.

Advantageously and according to the invention, as the printing composition for the first imprint, there is used a bonding agent comprising a rubber derivative which forms a glossy varnish, and in particular a blending base comprising a rubber derivative for silk-screen printing ink.

Advantageously and according to the invention, as the printing composition for the second imprint, there is used a two-component mixture which can be polymerised in situ, which, after polymerisation, forms a polyurethane layer.

Advantageously and according to the invention, a printing composition for the second imprint is selected, which provides a layer of transparent synthetic material.

In addition, advantageously and according to the invention, a matt polystyrene support sheet is used. In addition, preferably, advantageously and according to the invention, an opaque support sheet is used.

Advantageously and according to the invention, the varnish obtained from the first imprint is allowed to harden and/or dry completely, before the second imprint is begun.

In addition, advantageously and according to the invention, the first and second imprints are produced such that the thickness of the varnish formed by the first imprint is between one third and two thirds of the total thickness of the layer formed by the second imprint, and in particular approximately half, of the total thickness of the layer formed by the second imprint. Advantageously and according to the invention, the second imprint is produced such that the thickness of the layer formed is less than, or approximately 20 $\mu$m.

According to a variant of the invention, advantageously and according to the invention, in order to complete the film, there is also produced at least one coloured discontinuous additional layer, which can be seen by transparency, through the layer which is formed by the second imprint.

Advantageously and according to the invention, in order to complete the film, at least one continuous additional layer is produced.

Advantageously and according to the invention, each layer of the film is produced by printing of a two-component printing composition which can be polymerised in situ, which, after polymerisation, provides a polyurethane layer.

Advantageously and according to the invention, the film is covered with a continuous adhesive layer, such that a protective transfer is produced together with the support sheet, the film and this adhesive layer. The film is thus a transfer film which can be applied to the surface of a document, to which it adheres, in order to cover the latter at least partially and protect it against reproduction by optical scanning. The invention thus also provides a method for production of a protective transfer. Advantageously and according to the invention, a transparent adhesive layer is used. Advantageously and according to the invention, the adhesive layer is applied by printing of a composition which, after hardening and/or drying, is selected such as to form a contact adhesive (pressure-sensitive self-adhesive), and/or an adhesive which can be activated thermally.

Advantageously and according to the invention, the first imprint and/or the second imprint is produced by silk-screen printing. Advantageously and according to the invention, the method as a whole is implemented by means of silk-screen printing.

The invention also relates to a film obtained by a production method according to the invention. The invention thus extends to a film which has a surface made of synthetic material, known as the outer surface, which is designed to be on view, wherein it comprises an imprint provided recessed in the said outer surface, and with a surface condition which is more glossy than the remainder of the said outer surface, such as to form a symbol or pattern which prevents reproduction by optical scanning, and is visible from this outer surface side.

Advantageously and according to the invention, the film consists of a plurality of layers, the layer which has the said outer surface being a matt polyurethane layer which is provided with a recessed imprint which has a glossy surface condition. Advantageously and according to the invention, the various layers of the film are transparent.

The invention also extends to a protective transfer, comprising the film according to the invention. The invention thus relates to a protective transfer comprising a support sheet and an adhesive transferable protective film which is supported by the support sheet, such as to permit separation of the film and the sheet, and application and adhesion of the protective film on a surface of a document, in order to cover the latter at least partially and protect it, this film comprising an adhesive surface which is designed to be applied to the surface of the said document, and an opposite surface made of synthetic material known as the outer surface, which is designed to be on view when the film is applied to the said surface. According to the invention, the transfer is characterised in that the said outer surface of the film extends in contact with a non-glossy surface of the support sheet, and has a symbol or pattern which prevents reproduction by optical scanning, is designed to be on view on the said outer surface side, and is obtained from a recessed imprint provided in the said outer surface, this imprint having a surface condition which is more glossy than the remainder of the said outer surface, this imprint being left, after separation of the support sheet and the film, by a varnish which is printed discontinuously on the said non-glossy surface with which this varnish continues to be associated.

Advantageously and according to the invention, the support sheet is a matt polystyrene, and at least one layer of the film which has the said outer surface is a polyurethane layer. Advantageously and according to the invention, the film is transparent, such that it makes it possible to see inscriptions provided on the surface of the document to which it is applied, and/or on its surface in contact with this surface, and/or in the interior of the film.

In a method of protection according to the invention, a film according to the invention is used, obtained by a production method according to the invention. More particularly, advantageously and according to the invention, in order to apply the film to the document, a protective transfer according to the invention is used, which is obtained by means of a production method according to the invention.

The invention also extends to a document thus protected. The invention thus relates to a document which has a surface protected against reproduction by optical scanning, wherein it comprises a film which is applied to the said surface of the document, such as to have an outer surface which is on view, and an imprint recessed in the said outer surface, this imprint having a surface condition which is more glossy than the remainder of the said outer surface, such as to form a symbol or pattern which prevents reproduction of the document by optical scanning. Advantageously and according to the invention, the film is a film obtained by means of a method according to the invention.

It should be noted that, according to the invention, the imprint which is provided on the outer surface of the film is formed and obtained without added material. Thus, it cannot be removed from an original by scratching. Consequently, reproduction by optical scanning, of the inscriptions of the original which are disposed beneath the symbol or pattern formed by this imprint, is impossible, as is that of the symbol or pattern itself. It should also be noted that copying the original symbol or pattern on a film is rendered particularly problematic, since this sign or pattern is obtained indirectly from an imprint formed on the support sheet, rather than on the film itself.

Advantageously and according to the invention, the film used is a multi-layer anti-forgery film, in particular of the type described in EP-0 271 941.

The invention also relates to a method for protection, a film, a protective transfer, a method for production, and a document comprising in association all or part of the characteristics previously described, or described hereinafter.

BRIEF DESCRIPTION OF THE DRAWINGS

Other objects, advantages and characteristics of the invention will become more apparent from reading the following description of one of its preferred embodiments, provided by way of non-limiting example, with reference to the attached Figures, in which.

DESCRIPTION OF THE PREFERRED EMBODIMENT

Figure 1:
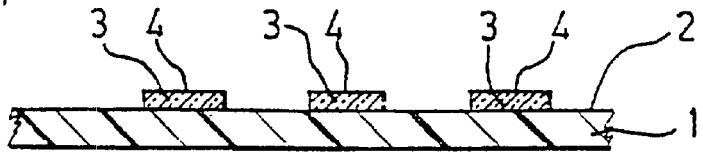
FIGS. 1, 2, and 3*a* illustrate respectively schematically in cross-section, on a highly enlarged scale, three successive steps of a method for production according to a first variant of the invention.

The method illustrated by way of example is implemented on silk-screen printing machines, in particular on conventional clapper (articulated screen) machines or on machines with an integrally raised screen (screen mobile in translation). A support sheet 1 of a non-adhesive type, ie. which can develop only low forces of bonding with most polymers, is placed on the plate of the silk-screen machine. This support sheet 1 can be a white opaque or translucent polystyrene sheet, the gram weight of which is approximately 100 to 250 g/m$^2$, approximately 100 to 250 $\mu$m thick. This support sheet 1 has a non-glossy surface 2, and its size is selected such that it is larger than that of the surface of the document to be protected.

The screen of the silk-screen machine is placed above the non-glossy surface 2 of the support sheet 1, and is provided with a printing composition which, after hardening and/or drying, is selected such as to form a glossy varnish which adheres to the said non-glossy surface 2. This composition is a varnish, ie. it is initially in liquid form, in order to allow it to be used for silk-screen printing, and is subsequently solidified by any method of solidification (evaporation of solvent, radiation, heat, etc). This printing composition can in particular be a glossy blending base comprising a rubber derivative for a silk-screen printing ink, for example a monotype glossy base number 15, as sold by the company CHIMITEC (France). This printing composition is used with a screen which is provided with printing symbols or patterns, such as to form on the support sheet 1 a first discontinuous imprint 3 of a glossy varnish which adheres to the non-glossy surface 2 of the support sheet 1. Opposite this surface 2, this glossy varnish has a glossy surface 4, which in particular is more glossy than the said non-glossy surface 2 of the support sheet 1.

The thickness of this first imprint 3 can be variable. Advantageously, this thickness is between 2 and 10 $\mu$m.

After production of this first imprint 3, the support sheet 1 and its imprint 3 are placed in a hot-air drying unit at 60° C. for approximately 1 minute, then cooled to ambient temperature. The support sheet 1 and its imprint 3 of varnish are then placed once more on the plate of the silk-screen machine, and covered with a screen which is provided with a printing composition, for a second continuous imprint. This printing composition is selected such that it is compatible with the varnish formed by the first imprint 3 (ie. such that it does not destroy or damage this varnish) and does not adhere to this varnish 3, ie. to the glossy surface 4 of this varnish, or at least adheres to this varnish 3 less strongly than this varnish 3 itself adheres to the non-glossy surface 2 of the support sheet 1. The printing composition of the second imprint is also selected such that, after hardening and/or drying, it does not adhere to the non-glossy surface 2 of the support sheet 1. For the composition of the second imprint, there is advantageously used a two-component mixture which can be polymerised in situ, which, after polymerisation, forms a layer of synthetic material, and in particular a polyurethane layer. For example, there can be used a two-component mixture which is prepared by adding two doses of hydroxylated polyacrylic resin or hydroxylated polyester resin, or hydroxylated polyether resin with a low molecular weight, and a dose of aliphatic or aromatic tri-functional polyisocyanate (for example polyacrylic resin "ref. U8560" and trimerised hexamethylene diisocyanate "ref. 8580", sold by the company CHIMITEC (France)).

Figure 2:
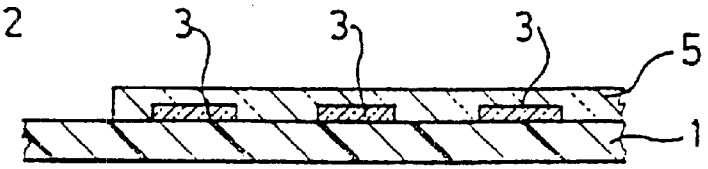

The quantity of the mixtures spread on the silk screen for the second printing is adjusted to correspond to a thickness of between 10 $\mu$m and 20 $\mu$m. The silk screen used is such that the second imprint is of the continuous type, ie. it forms a continuous layer 5, which covers completely the first discontinuous imprint 3 (FIG. 2), and thus constitutes a first layer of a film. It will be appreciated that a single silk screen can be used to produce a plurality of films simultaneously. Each layer 5 of the second imprint has a peripheral dimension and shape corresponding to those of the portion of surface of the document to be protected.

The second imprint is produced such that the thickness of the layer 5 formed is preferably less than 20 μm, or approximately 20 μm. Advantageously, the first and second imprints are produced such that the thickness of the varnish 3 formed by the first imprint is between one third and two thirds, and in particular approximately half, of the total thickness of the layer 5 formed by the second imprint.

A further imprint is then produced above the layer 5 of the second imprint, by means of an adhesive material, as described for example in EP-A-0 271 941 and U.S. Pat. No. 5,232,527. In particular, it should be noted that a continuous layer of adhesive material 6 is applied by silk screen printing before the layer 5 of the second imprint of polyurethane is completely polymerised.

As the adhesive material, there can be used a self-adhesive which is pressure-sensitive in cold conditions, such as an acrylic adhesive in aqueous dispersion, or an adhesive which can be reactivated hot, and is applied cold, compatible with the polyurethane layer 5, and in particular a glue which can be thermally reactivated, consisting of a copolymer in an aqueous dispersion, such as a polyurethane adhesive ref. AD45 or ADTH made by the company CHIMITEC (France).

Figure 3A:
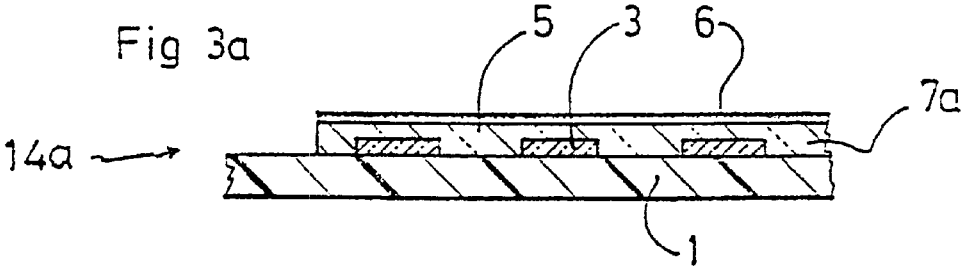
Figure 4:
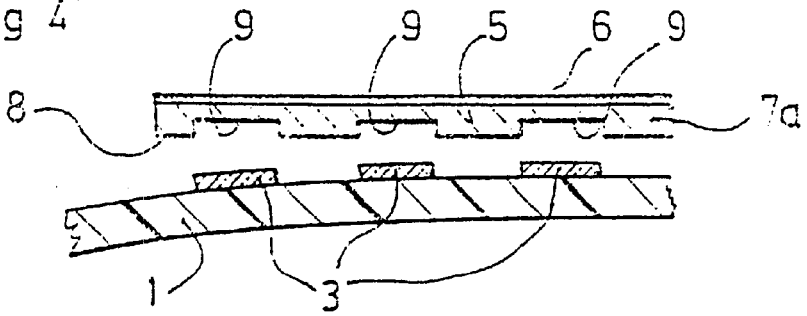
FIG. 4 illustrates schematically in cross-section, on a highly enlarged scale, separation of the film and the support sheet in the first variant of the invention.

There is thus obtained a protective transfer 14*a*, as shown in FIG. 3*a*, comprising a support sheet 1 and a film 7*a*, comprising a polyurethane layer 5 and an adhesive layer 6. Since the polyurethane layer 5 does not adhere either to the varnish of the first imprint 3, or to the support sheet 1, it can be separated as shown in FIG. 4. Opposite the adhesive layer 6, the film 7*a* then has a surface 8 which has a glossy imprint 9 left by the varnish 3 of the first imprint, this imprint 9 forming a symbol or a discontinuous pattern which is on view, and prevents reproduction by optical scanning. In fact, this imprint 9 is glossy since the surface 4 of the varnish 3 with which it was in contact is also glossy. On the other hand, the remainder of the surface 8 of the film 7*a* is matt, or at least is less glossy than the imprint 9, like the non-glossy surface 2 of the support sheet 1. The glossy imprint 9 is recessed in the thickness of the film 7*a*, relative to the remainder of the surface 8 (FIG. 4), by a height which corresponds to the thickness of the first imprint 3, and in particular of between 2 and 10 μm.

For example, with a support sheet 1 made of matt white opaque polystyrene which has a gram weight of 125 g/m$^2$, and is approximately 120 μm thick, and a glossy base with a monotype rubber derivative no. 15 made by the company CHIMITEC (France), the imprint 9 formed on the film 7*a* has glossiness measured in white light on the BYK GARDNER brightness measurer, greater than 68% at 85° (angle of incidence of the light), and greater than 70% at 60°. On the other hand, the remainder of the surface 8 of the film has glossiness less than 26% at 85°, and less than 16% at 60°, and is thus matt.

Thus, it can be seen that the surface condition of the film 7*a* corresponds to the surface condition of the support 1 onto which it has been applied for production by silk-screen printing. In order to produce a film according to the invention, for the second imprint, it is thus sufficient to use a material which has this property. Thus, any material other than polyurethane which fulfills this requirement, and which permits subsequent separation of the film and the support sheet 1, can be envisaged.

Figure 3B:
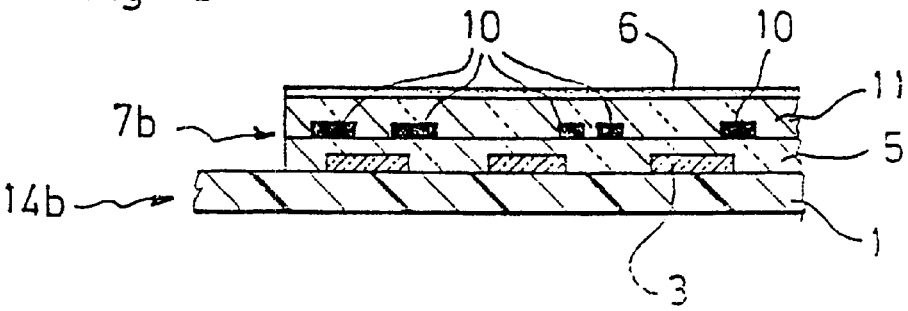
FIG. 3*b* illustrates schematically in cross-section on a highly enlarged scale, a second variant of a method for production according to the invention.

FIG. 3*b* shows a variant embodiment of a protective transfer 14*b*, in which the film 7*b* is of the multi-layer type. For this purpose, the method described in EP-A-0 271 941 and U.S. Pat. No. 5,232,527 can be used. Starting with the stacking obtained in FIG. 2, and before the end of complete polymerisation of the layer 5, there is produced an additional discontinuous layer 10 of a coloured intermediate imprint, which can be seen by transparency through the layer 5 formed by the second imprint 5, which itself is transparent. There is then produced at least one other additional continuous layer 11, before the discontinuous layer 10 is completely polymerised, then the adhesive layer 6 is added. There is then obtained the film 7*b*, comprising the continuous layer 5 of polyurethane of the second imprint, which will be provided with glossy imprints 9, which prevent reproduction by optical scanning, the discontinuous layer 10 of coloured polyurethane, the continuous layer 11 of polyurethane, and the layer 6 of adhesive material.

Preferably, each layer of the film 7*a*, 7*b*, with the exception of the adhesive layer 6, is produced by printing a two-component printing composition which can be polymerised in situ, and which, after polymerisation, provides a polyurethane layer. This then provides a composite polyurethane film 7*a*, 7*b*, with an integrated pattern or symbol in the multi-layer variant 7*b*, in which the various layers 5, 10, 11 are not separable.

Advantageously and according to the invention, each continuous layer 5, 11, 6 of the film 7*a*, 7*b* is transparent, such that the film can be used to cover and protect the surface of a document, whilst permitting reading of inscriptions contained on this document and/or on the film itself (in particular the discontinuous intermediate printing patterns or symbols 10). On the other hand, preferably and according to the invention, the support sheet 1 is opaque, such that it is easier to recognise further the presence of the imprints 9 by transparency through the film.

In addition, advantageously and according to the invention, the first imprint 3 is produced such that the glossy imprint 9 is formed at least facing portions of the film 7*a*, 7*b* which are designed to be applied to areas of the document 12 to be protected, and/or of the film 7*a*, 7*b*, which bear inscriptions which must be visible by transparency, such as a photograph glued or printed, a hologram inserted in the film 7*b*, or the like. In fact, it is found that the film 7*a*, 7*b* has improved transparency in its portions opposite the glossy imprint 9.

Figure 5:
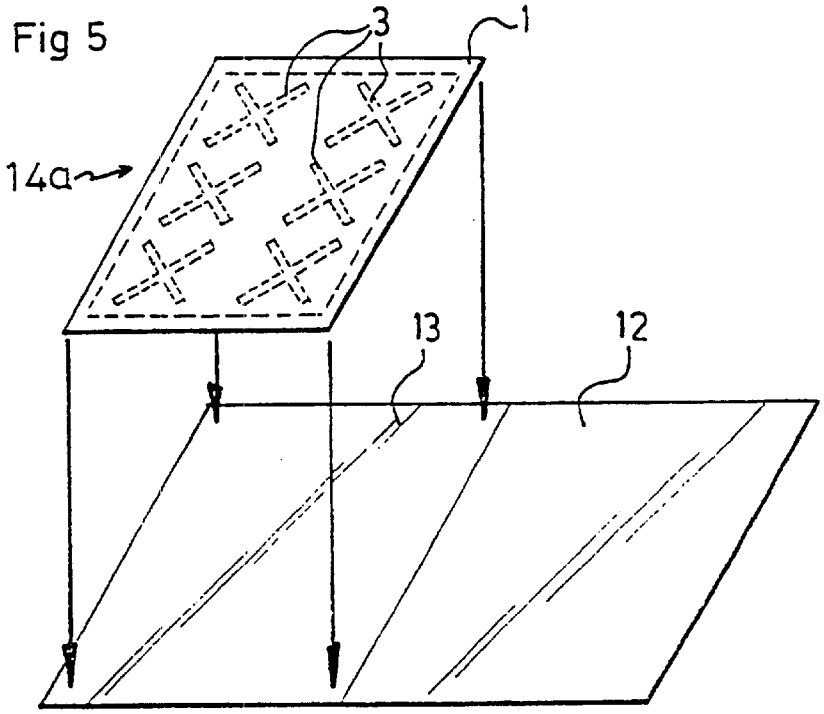
FIGS. 5 and 6 are schematic perspective views illustrating use of a protective transfer according to the first variant of the invention shown in FIG. 3*a*, for implementation of a method according to the invention for protection of a document.
Figure 6:
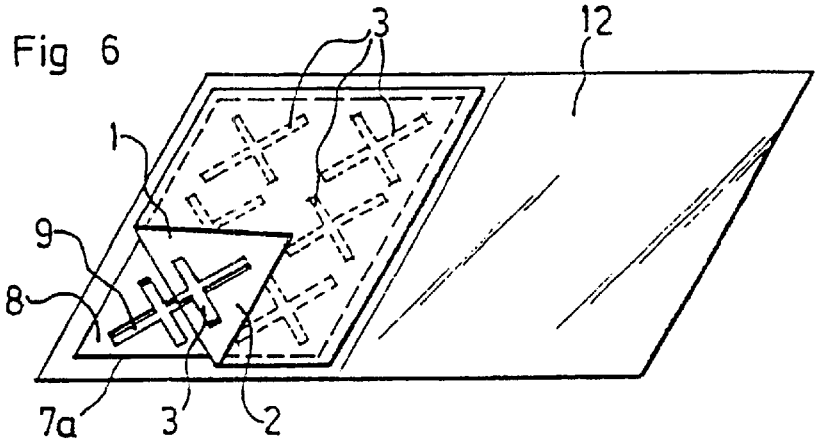
Figure 7:
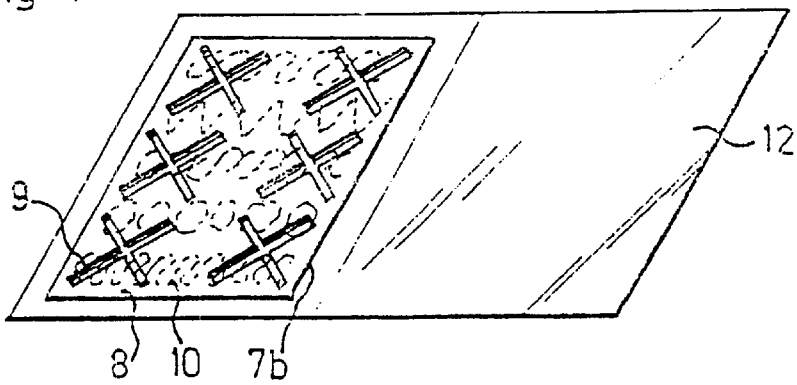
FIG. 7 is a schematic perspective view illustrating a document according to the invention obtained on completion of the step in FIG. 6, but with a film according to the second variant of the invention shown in FIG. 3*b*.

FIGS. 5 to 7 illustrate a method for use of a protective transfer 14*a* or 14*b*, as obtained and shown in FIGS. 3*a* or 3*b*, and comprising an opaque matt polystyrene support sheet 1, and a protective film 7*a* or 7*b*.

The transfer 14*a* is selected to match the dimensions of the surface 13 of the document 12 to be protected. It is presented with the layer 6 of adhesive material oriented towards the surface 13, the support sheet 1 being opposite. The layer 6 of adhesive material is then applied against this surface 13 to be protected, such as to make the film 7*a* or 7*b* adhere to this surface 13. In the case of a self-adhesive, it is sufficient to apply pressure. In the case of an adhesive which is reactivated by heat, heating takes place before and/or during application, of the transfer 14*a*, 14*b*, or at least of the layer 6 of adhesive material. After application and adhesion, the support sheet 1 is separated from the film 7*a*, 7*b*, as shown in FIG. 6. During this separation, it should be noted that the symbol or pattern formed by the varnish 3 (which, by way of example in the Figures, is in the shape of an X) remains integral with the support sheet 1, and leaves in the outer surface 8 of the films 7*a*, 7*b*, an imprint 9 which forms the same symbol or the same pattern recessed. This imprint 9 is glossy, whereas the remainder of the surface 8 is matt, such that reproduction by optical scanning of the document obtained, which is thus protected, is not possible. FIG. 7 shows a document coated with a film 7*b* of a multi-layer type with intermediate printing 10.

The imprint 9 also permits initial authentication of the document, since its presence shows that the document is an original. After application of the film 7*a*, 7*b*, it is no longer possible to reproduce the document 12 by optical scanning, and in particular, it is not possible to photocopy it. Furthermore, it is no longer possible to remove the film 7*a*, 7*b* without damaging it. This film 7*a*, 7*b* thus also makes it possible to combat forgery.

It should also be noted that scratching the imprint 9 damages the polyurethane film 7*a*, 7*b* and does not efface the glossy pattern or symbol formed by this imprint 9. Thus, it is not possible to re-establish the photocopiable nature of the document by scratching. Thus, it is absolutely impossible to reproduce by photocopying or by means of a scanner the inscriptions supported by the document 12 on the surface 13 and/or by the film 7*a*, 7*b* itself, even though these inscriptions can be seen through the film 7*a*, 7*b*.

The invention can form the basis of many variants. In particular, the film 7*a*, 7*b* can be applied to only part of the surface 13 to be protected, and a plurality of films 7*a*, 7*b* can be applied to a single surface 13 of the document. Also, the film 7*a*, 7*b* can consist of a larger number of layers. Other printing methods can be used to produce the film, using other synthetic materials.

What is claimed is:

1. A method producing a film (7*a*, 7*b*) with an outer surface (8) made of synthetic material, the outer surface having a symbol or pattern non-reproducible by optical scanning, comprising the steps of:

selecting a support sheet (1) with a non-glossy surface (2) on which the synthetic material of the outer surface (8) of the film will not adhere;

producing on the non-glossy surface (2) a first discontinuous imprint (3) by use of a printing composition that after hardening or drying forms a varnish (3) adhering to the non-glossy surface (2), the varnish (3) having a surface condition more glossy than that of the non-glossy surface (2);

producing on the first imprint (3), a second continuous imprint of a printing composition that after hardening or drying forms a synthetic material layer (5) having one surface in contact with the non-glossy surface (2) and the varnish (3); and completing production of the film on the synthetic material layer (5), wherein, the one surface of the synthetic material layer (5) in contact with the non-glossy surface (2) and the varnish (3) constitutes the outer surface (8) of the film (7*a*, 7*b*) which will not adhere to the non-glossy surface (2) of the support sheet (1), the synthenic material layer (5) adheres to the varnish (3) less strongly than the varnish (3) itself adheres to the non-glossy surface (2) of the support sheet (1), the synthetic material layer (5) is separable, at the outer surface (8) of the film, from the support sheet (1) with the varnish (3) remaining attached on the support sheet (1), upon separation of the outer surface (8) of the film from the support sheet, first portions of the outer surface (8) of the film having previously been in contact with the varnish having a more glossy finish than second portions of the outer surface of the film not having previously been in contact with the varnish, and the first portions of the outer surface of the film form a viewable symbol or pattern preventing reproduction therethrough by optical scanning.

2. The method of claim 1, wherein, a bonding agent comprising a rubber derivative is used as the printing composition to form the varnish during the first discontinuous imprint.

3. The method of claim 1, wherein, a blending base comprising a rubber derivative for a silk-screen printing ink is used as the printing composition for the first discontinuous imprint.

4. The method of claim 1, wherein, a two-component mixture which can be polymerized in situ, and which after polymerization forms a polyurethane layer, is used as the printing composition for the second continuous imprint.

5. The method of claim 1, wherein, the printing composition for the second continuous imprint provides a layer of transparent synthetic material.

6. The method of claim 1, wherein, the support sheet is a matt polystyrene support sheet.

7. The method of claim 1, wherein, the support sheet is an opaque support sheet.

8. The method of claim 1, wherein, the step of producing a second continuous imprint begins after the varnish obtained from the first imprint is completely hardened or dried.

9. The method of claim 1, wherein, a thickness of the varnish formed by the first imprint is between one third and two thirds of a total thickness of the synthetic material layer formed by the second continuous imprint.

10. The method of claim 9, wherein, the thickness of the varnish formed by the first imprint is approximately half the total thickness of the synthetic material layer formed by the second continuous imprint.

11. The method of claim 1, wherein, the synthetic material layer formed by the second continuous imprint is no greater than approximately 20 microns.

12. The method of claim 1, wherein, the step of completing production of the film on the synthetic material layer includes a step of producing at least one colored discontinuous additional layer (10) on the synthetic material layer, the at least one colored discontinuous layer being visible by transparency through the synthetic material layer.

13. The method of claim 1, wherein, the step of completing production of the film on the synthetic material layer includes a step of producing a continuous additional layer (11) on the synthetic material layer.

14. The method of claim 13, wherein both the synthetic material layer and the continuous additional layer are produced by printing a two-component printing composition that can be polymerized in situ, and after polymerization provides a polyurethane layer.

15. The method of claim 1, wherein, the step of completing production of the film on the synthetic material layer includes a step of covering the synthetic material layer with a continuous adhesive layer (6) to produce a protective transfer (14*a*, 14*b*), the film (7*a*, 7*b*) being able to be applied and adhered to a document surface (13) to at least partially cover the document surface and protect the document surface against reproduction by optical scanning.

16. The method of claim 15, wherein, the adhesive layer (6) is transparent.

17. The method of claim 15, wherein, the adhesive layer (6) is added by printing.

18. The method of claim 1, wherein, silk-printing is used to make the first discontinuous imprint (3) or the second continuous imprint (5).

19. The method of claim 17, wherein, each printing step is implemented by silk-screen printing.

20. A method for protecting a document surface (13) against optical scanning reproduction, comprising the step of applying irreversibly to the document surface (13) at least one film (7*a*, 7*b*) comprising a layer (5) of synthetic material having an imprint (9) recessed on an outer surface (8) of the synthetic material layer, wherein, the imprint (9) has a surface condition which is more glossy than a remainder of the outer surface (8), the imprint (9) forming a symbol or pattern that prevents reproduction by optical scanning of the document surface.

21. The method of claim 20, wherein, the film is formed from a plurality of layers, the synthetic material layer (5) having the outer surface (8) is a matt polyurethane layer and the imprint has a glossy surface condition.

22. The method of claim 20, wherein, a film (7*a*, 7*b*) applied to the document surface is produced by:

selecting a support sheet (1) with a non-glossy surface (2) on which the synthetic material of the outer surface (8) of the film will not adhere;

producing on the non-glossy surface (2) a first discontinuous imprint (3) by use of a printing composition that after hardening or drying forms a varnish (3) adhering to the non-glossy surface (2), the varnish (3) having a surface condition more glossy than that of the non-glossy surface (2);

producing on the first imprint (3), a second continuous imprint of a printing composition that after hardening or drying forms a synthetic material layer (5) having one surface in contact with the non-glossy surface (2) and the varnish (3); and completing production of the film on the synthetic material layer (5), wherein, the one surface of the synthetic material layer (5) in contact with the non-glossy surface (2) and the varnish (3) constitutes the outer surface (8) of the film (7*a*, 7*b*) which will not adhere to the non-glossy surface (2) of the support sheet (1), the synthetic material layer (5) adheres to the varnish (3) loss strongly than the varnish (3) itself adheres to the non-glossy surface (2) of the support sheet (1), the synthetic material layer (5) is separable, at the outer surface (8) of the film, from the support sheet (1) with the varnish (3) remaining attached on the support sheet (1), and upon separation of the outer surface (8) of the film from the support sheet, first portions of the outer surface (8) of the film having previously been in contact with the varnish having a more glossy finish than second portions of the outer surface of the film not having previously been in contact with the varnish, and the first portions of the outer surface of the film form a viewable symbol or pattern preventing reproduction therethrough by optical scanning.

23. The method of claim 20, wherein, the film applied to the document surface is part of a protective transfer.

* * * * *